US007675501B2

(12) United States Patent
Shin et al.

(10) Patent No.: US 7,675,501 B2
(45) **Date of Patent: *Mar. 9, 2010**

(54) LIQUID CRYSTAL DISPLAY APPARATUS WITH LIGHT SENSOR

(75) Inventors: Kyoung-Ju Shin, Yongin-si (KR); Chong-Chul Chai, Seoul (KR); Cheol-Woo Park, Suwon-si (KR); Sang-Il Kim, Suwon-si (KR); Jin-Hong Kim, Seoul (KR); Mun-Pyo Hong, Seongnam-si (KR)

(73) Assignee: Samsung Electronics Co., Ltd. (KR)

( * ) Notice: Subject to any disclaimer, the term of this patent is extended or adjusted under 35 U.S.C. 154(b) by 1046 days.

This patent is subject to a terminal disclaimer.

(21) Appl. No.: 11/013,568

(22) Filed: Dec. 16, 2004

(65) Prior Publication Data

US 2005/0179682 A1 Aug. 18, 2005

(30) Foreign Application Priority Data

Dec. 17, 2003 (KR) ..... 10-2003-0092308
Jan. 17, 2004 (KR) ..... 10-2004-0003540

(51) Int. Cl.
*G09G 3/36* (2006.01)

(52) U.S. Cl. ..... 345/102

(58) Field of Classification Search ..... 345/102, 345/207; 349/116; 257/431–466; 250/200, 250/205, 214 A, 214 AL, 214 R, 124 AG, 250/214 LA, 330–334, 338.1–353
See application file for complete search history.

(56) References Cited

U.S. PATENT DOCUMENTS 4,868,459 A * 9/1989 Dennerlein et al. ..... 315/158
5,760,760 A * 6/1998 Helms ..... 345/102
5,769,384 A * 6/1998 Baumgartner et al. ... 250/214 A
5,786,876 A * 7/1998 Ota et al. ..... 349/42
6,410,961 B1 * 6/2002 Hayashi ..... 257/349
7,002,547 B2 * 2/2006 Yamada ..... 345/102

(Continued)

FOREIGN PATENT DOCUMENTS

CN 1459997 A 12/2003
JP 1114962 A 1/1999

OTHER PUBLICATIONS

First Office Action from Chinese Patent Office for Chinese Application No. 200410103350.7 dated Mar. 14, 2008, with English translation.

*Primary Examiner*—Sumati Lefkowitz
*Assistant Examiner*—Robert E Carter, III
(74) *Attorney, Agent, or Firm*—Cantor Colburn LLP

(57) ABSTRACT

In a display apparatus, a light generating part generates a first light in response to a driving signal, and a first driving part outputs a panel driving signal. A display panel receives the first light from the light generating part and a second light externally provided, and displays an image in response to the panel driving signal. A light sensing part is disposed in the display panel so as to output a sensing signal corresponding a light amount of the second light. A second driving part compares the sensing signal with a predetermined reference value, and outputs a driving signal in accordance with the compared result. Thus, the display apparatus may reduce an electrical power consumed to drive the display apparatus.

26 Claims, 12 Drawing Sheets

U.S. PATENT DOCUMENTS

| | | | | |
|---|---|---|---|---|
| 7,211,880 | B2 * | 5/2007 | Izumi | 257/678 |
| 2001/0011983 | A1 * | 8/2001 | Shiraki et al. | 345/92 |
| 2001/0055010 | A1 * | 12/2001 | Kaise et al. | 345/204 |
| 2003/0020969 | A1 * | 1/2003 | Kimura | 358/505 |
| 2003/0137485 | A1 * | 7/2003 | Wei et al. | 345/102 |
| 2003/0234759 | A1 * | 12/2003 | Bergquist | 345/92 |
| 2004/0227719 | A1 * | 11/2004 | Chang et al. | 345/102 |

* cited by examiner

LIQUID CRYSTAL DISPLAY APPARATUS WITH LIGHT SENSOR

CROSS-REFERENCE TO RELATED APPLICATION

This application relies for priorities upon Korean Patent Application No. 2003-92308 filed on Dec. 17, 2003 and Korean Patent Application No. 2004-3540, the contents of which are herein incorporated by reference in their entireties.

BACKGROUND OF THE INVENTION

1. Field of the Invention

The present invention relates to a display apparatus. More particularly, the present invention relates to a display apparatus capable of reducing power consumption.

2. Description of the Related Art

In general, a display apparatus includes a display panel that displays an image using light. As the light, the LCD panel may use an external light externally provided from sun or lighting, or an internal light generated therefrom.

Recently, a display apparatus has been developed so as to allow the display panel to appropriately use the external light or the internal light in accordance with a display mode thereof. That is, the display apparatus may display the image using the external light when the external light is sufficient to display the image. On the contrary, the display apparatus may display the image using the internal light generated from a backlight assembly when the external light is insufficient to display the image.

An electrical power of about 70% needed to drive the display apparatus is consumed to drive the backlight assembly. Thus, a mobile electric device, for example, such as a cellular phone, a notebook computer, a PDA etc., requires a structure capable of reducing the electrical power consumed in the backlight assembly.

However, when the electrical power supplied to the backlight assembly decreases in order to reduce the power consumption in the display apparatus, an light-emission amount of the internal light generated from the backlight assembly may be reduced, thereby deteriorating brightness of the display apparatus.

BRIEF SUMMARY OF THE INVENTION

The present invention provides a display apparatus capable of reducing power consumption.

In one aspect of the present invention, a display apparatus includes a light generating part, a first driving part, a display panel, a light sensing part and a second driving part.

The light generating part generates a first light in response to a driving signal, and the first driving part outputs a panel driving signal. The display panel receives the first light from the light generating part or a second light externally provided, and displays an image in response to the panel driving signal.

The light sensing part is disposed in the display panel, and outputs a sensing signal in response to a light amount of the second light. The second driving part compares the sensing signal with a predetermined reference value, and provides the driving signal to the light generating part in accordance with the compared result.

According to the display apparatus, the light generating part is turned on or turned off in accordance with the light amount of the second light. Thus, an electrical power needed to drive the display apparatus may be reduced.

BRIEF DESCRIPTION OF THE DRAWINGS

The above and other advantages of the present invention will become readily apparent by reference to the following detailed description when considered in conjunction with the accompanying drawings wherein.

DESCRIPTION OF THE PREFERRED EMBODIMENT

Hereinafter, the present invention will be explained in detail with reference to the accompanying drawings.

Figure 1:
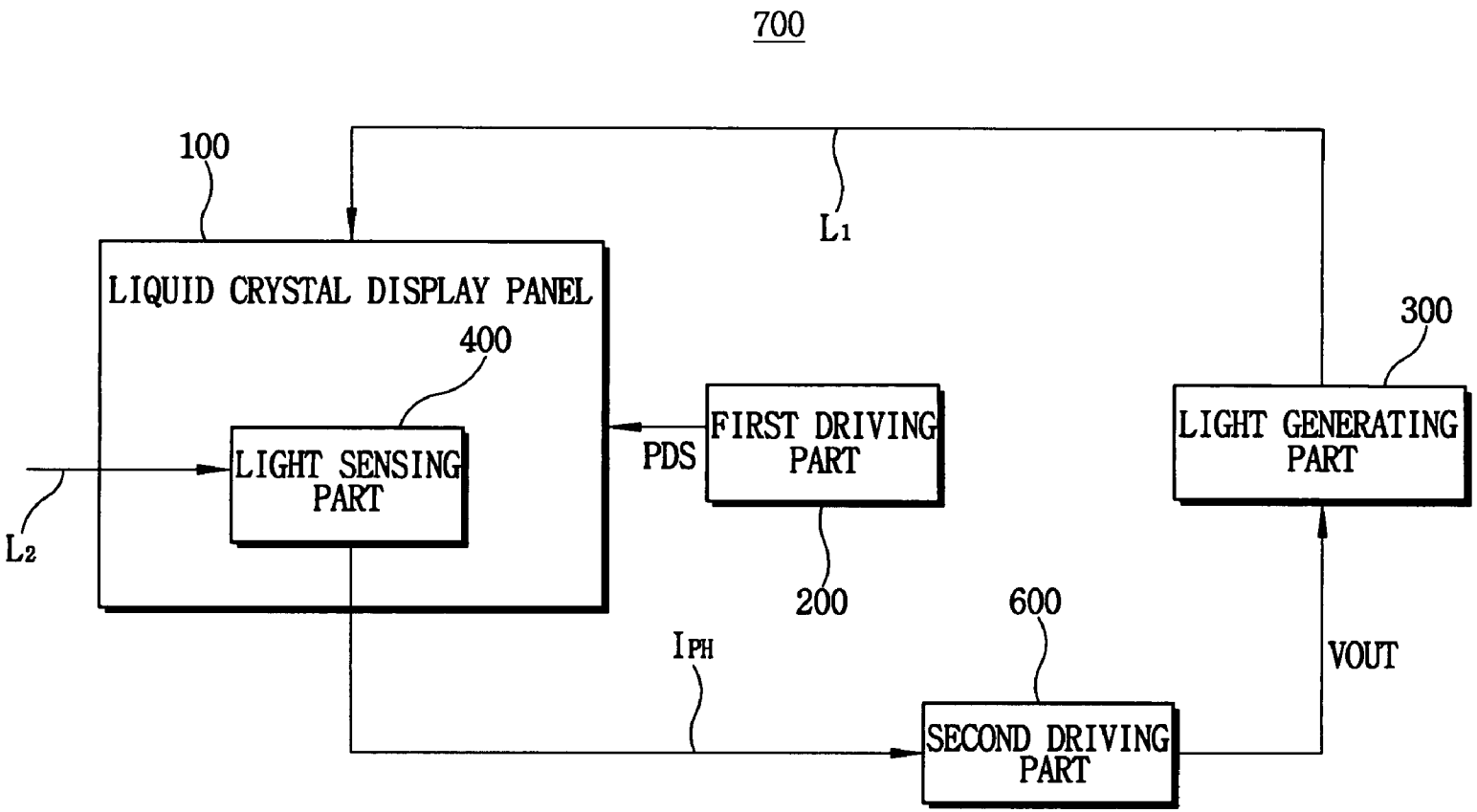
FIG. 1 is a block diagram showing a liquid crystal display apparatus according to an exemplary embodiment of the present invention.

FIG. 1 is a block diagram showing a liquid crystal display apparatus according to an exemplary embodiment of the present invention.

Referring to FIG. 1, a liquid crystal display apparatus 700 according to an exemplary embodiment of the present invention includes a liquid crystal display panel 100, a first driving part 200 that outputs a panel driving signal PDS so as to drive the liquid crystal display panel 100, a light generating part 300 that provides an internal light L1 to the liquid crystal display panel 100, and a second driving part 600 that drives the light generating part 300.

The liquid crystal display panel 100 includes a light sensing part 400 that outputs a photocurrent $I_{PH}$ in response to a light amount of an external light L2 provided thereto. The second driving part 600 outputs a driving voltage $V_{OUT}$ in response to the photocurrent $I_{PH}$ outputted from the light sensing part 400 so as to drive the light generating part 300.

When the light generating part 300 outputs the internal light L1 in response to the driving voltage $V_{OUT}$, the outputted internal light L1 is provided to the liquid crystal display panel 100. Thus, the liquid crystal display panel 100 displays an image using the internal light L1. On the contrary, when the light generating part 300 does not output the internal light L1 in response to the driving voltage $V_{OUT}$, the liquid crystal display panel 100 displays the image using only the external light L2. That is, when the external light L2 is insufficient to display the image, the liquid crystal display panel 100 displays the image using the internal light L1, and when the external light L2 is sufficient to display the image, the liquid crystal display panel 100 displays the image using only the external light L2.

Thus, the liquid crystal display apparatus 700 turns on or turns off the light generating part 300 according to the light amount of the external light L2, so that an electrical power needed to drive the liquid crystal display apparatus 700 may be reduced without deterioration of the liquid crystal display apparatus 700.

Figure 2:
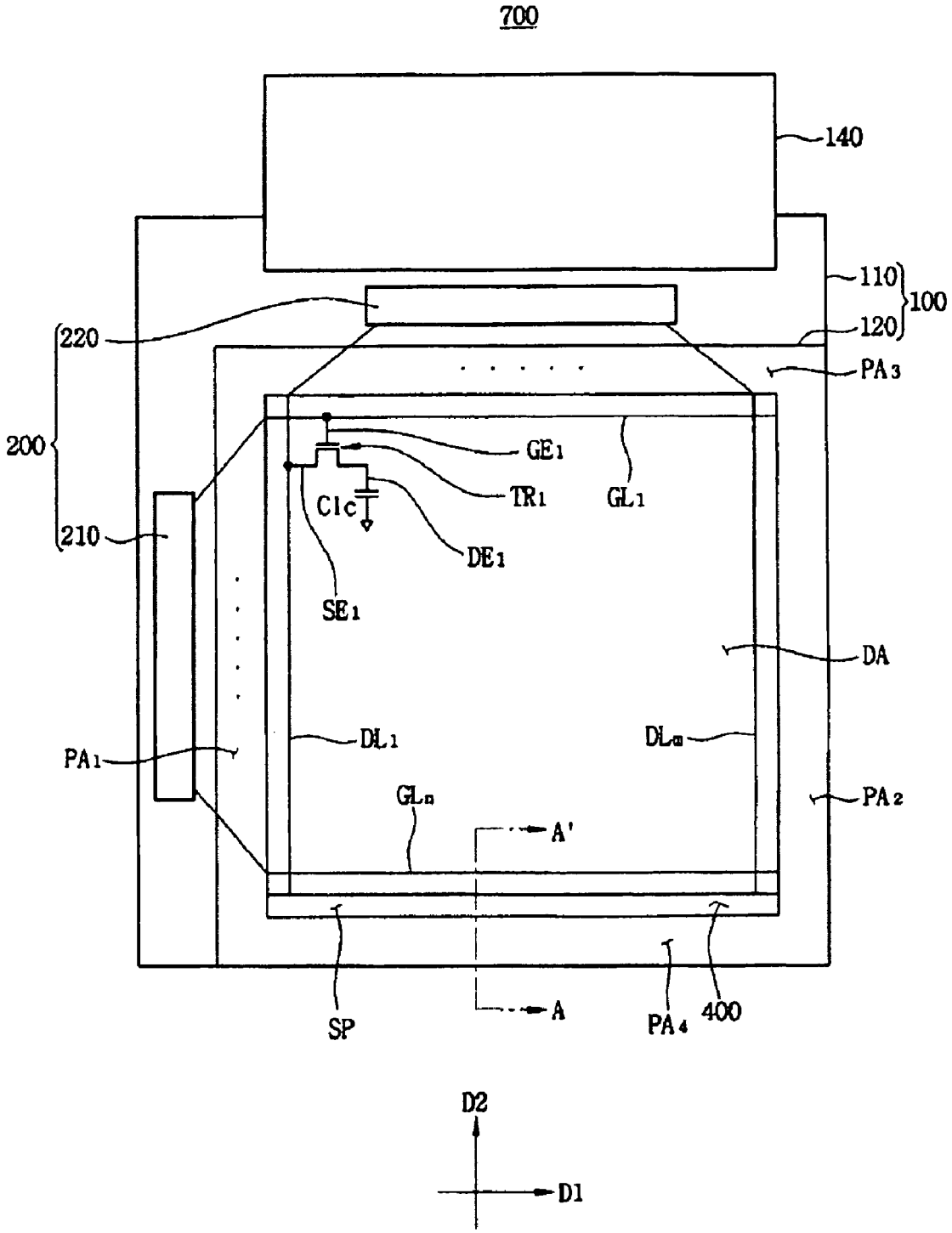
FIG. 2 is a plane view showing the liquid crystal display apparatus shown in FIG. 1.
Figure 3:
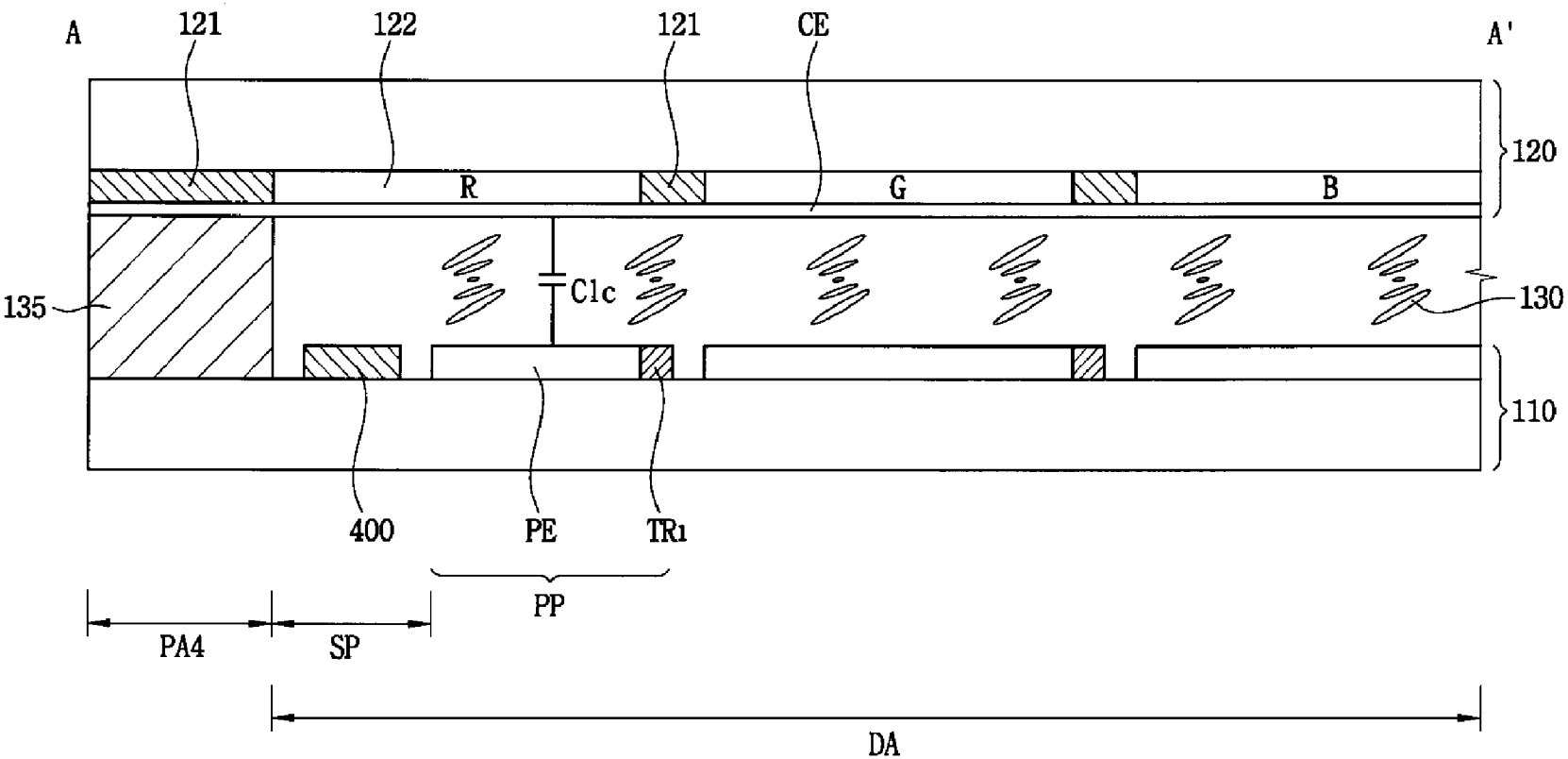
FIG. 3 is a cross-sectional view showing the liquid crystal display apparatus shown in FIG. 2.

FIG. 2 is a plane view showing the liquid crystal display apparatus shown in FIG. 1. FIG. 3 is a cross-sectional view showing the liquid crystal display apparatus shown in FIG. 2.

Referring to FIGS. 2 and 3, the liquid crystal display apparatus 700 includes the liquid crystal display panel 100. The liquid crystal display panel 100 includes a lower substrate 110, an upper substrate 120 facing the lower substrate 110, a liquid crystal layer 130 disposed between the lower and upper substrates 110 and 120, and a sealing member 135. The liquid crystal display panel 100 includes a display area DA on which the image is displayed, first, second, third and fourth peripheral areas PA1, PA2, PA3 and PA4 adjacent to the display area DA and surrounding the display area DA. The display area DA includes an end portion SP, which is located in an outer, e.g., peripheral, area of the display area DA adjacent to one of the first, second, third or fourth peripheral areas PA1, PA2, PA3 or PA4. For example, the end portion SP is adjacent to the fourth peripheral area PA4 in the exemplary embodiment of the present invention shown in FIG. 2.

The lower substrate 100 includes a plurality of pixel parts PP arranged in a first substrate 101 as in a matrix configuration corresponding to the display area DA. Each of the pixel parts PP includes a pixel thin film transistor (TFT) TR1 and a pixel electrode PE. The first substrate 101 includes a first gate line to an n-th gate line GL1-GLn formed thereon and extended in a first direction D1, and a first data line to a m-th data line DL1-DLm formed thereon and extended in a second direction D2 substantially perpendicular to the first direction D1. The first to n-th gate lines GL1-GLn and the first to n-th data lines DL1-DLm are formed in an area corresponding to the display area DA. The pixel TFT TR1 includes a gate electrode GE1 electrically connected to the first gate line GL1, a source electrode SE1 electrically connected to the first data line DL1, and a drain electrode DE1 electrically connected to the pixel electrode PE.

The first peripheral area PA1 is adjacent to first ends of the first to n-th gate lines GL1-GLn, and the second peripheral area PA2 is adjacent to second ends of the first to n-th gate lines GL1-GLn, which are opposite to the first ends. Also, the third peripheral area PA3 is adjacent to third ends of the first to m-th data lines DL1-DLm, and the fourth peripheral area PA4 is adjacent to fourth ends of the first to m-th data lines DL1-DLm, which are opposite to the third ends.

The upper substrate 120 includes a light blocking layer 121, a color filter 122 and a common electrode CE. The color filter 122 includes red, green and blue color pixels. The light blocking layer 121 is disposed between the red, green and blue color pixels so as to prevent interference between the red, green and blue color pixels, thereby enhancing color reproducibility. Also, the light blocking layer 121 is formed at a position corresponding to the first, second, third and fourth peripheral areas PA1, PA2, PA3 and PA4. The common electrode CE is uniformly formed on the light blocking layer 121 and the color filter 122 in thickness. The common electrode CE faces the pixel electrode PE so as to form a liquid crystal capacitor Clc. The liquid crystal layer 130 is also disposed between the common electrode Ce and the liquid crystal layer 130.

The first driving part 200 that drives the liquid crystal display panel 100 includes a gate driving chip 210 mounted in the first peripheral area PA1 and a data driving chip 220 mounted in the third peripheral area PA3.

The gate driving chip 210 is electrically connected to the first ends of the first to n-th gate lines GL1-GLn in the first peripheral area PA1 so as to sequentially output a gate signal to the first to n-th gate lines GL1-GLn. The data driving chip 220 is electrically connected to the third ends of the first to m-th gate lines DL1-DLm in the third peripheral area PA3 so as to output a data signal to the first to m-th data lines DL1-DLm.

The light sensing part 400 is disposed in the end portion SP of the display area DA, which is adjacent to the fourth peripheral area PA4, as shown in FIG. 2. The light sensing part 400 senses the light amount of the external light L2 (shown in FIG. 1) provided from an outside of the liquid crystal display panel 100, and outputs the photocurrent $I_{PH}$ (shown in FIG. 1) corresponding to the light amount of the external light L2. When the light amount of the external light L2 increases, the photocurrent $I_{PH}$ increases, and when the light amount of the external light L2 decreases, the photocurrent $I_{PH}$ decreases.

Since the data driving chip 220 is electrically connected to only the third ends of the first to m-th data lines DL1-DLm, the fourth ends of the first to m-th data lines DL1-DLm do not extend to the fourth peripheral area PA4. Thus, although the light sensing part 400 is disposed at the end portion SP of the display area DA, the light sensing part 400 does not overlap with the first to m-th data lines DL1-DLm. Therefore, although the light sensing part 400 is disposed in the display area DA, the liquid crystal display apparatus 700 may prevent distortion of the gate signal or the data signal provided to the display area DA.

A flexible printed circuit board 140 is attached into the third peripheral area PA3. The flexible printed circuit board 140 receives various signals, and provides the various signals to the gate driving chip 210, the data driving chip 220 and the light sensing part 400.

Figure 4:
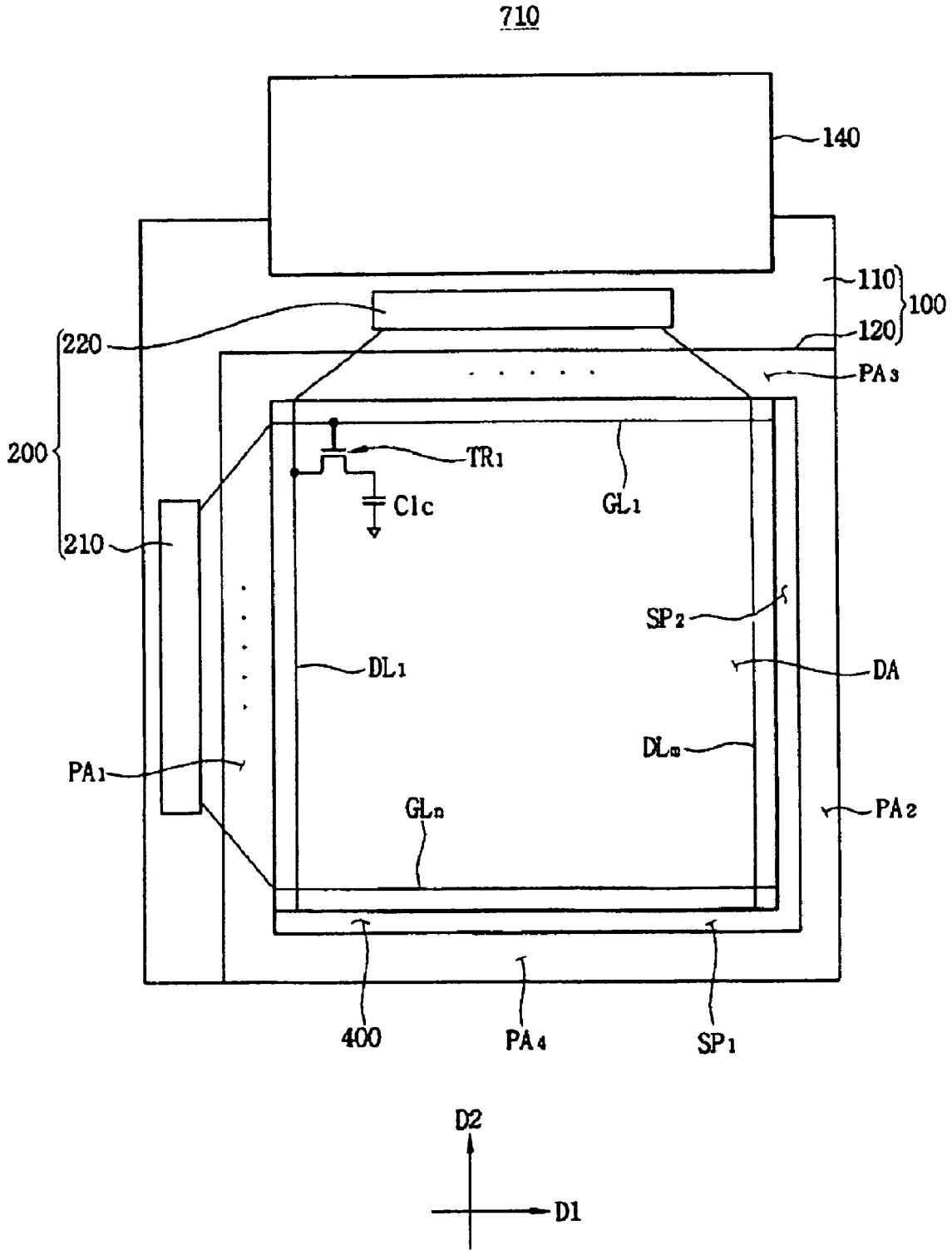
FIG. 4 is a plane view showing a liquid crystal display apparatus according to another exemplary embodiment of the present invention.

FIG. 4 is a plane view showing a liquid crystal display apparatus according to another exemplary embodiment of the present invention. In FIG. 4, the same reference numerals denote the same elements in FIG. 3, and thus the detailed descriptions of the same elements will be omitted.

Referring to FIG. 4, a light sensing part 400 is disposed at a first end portion SP1 of the display area DA adjacent to the fourth peripheral area PA4 and a second end portion SP2 of the display area DA adjacent to the second peripheral area PA2.

Since the data driving chip 220 is electrically connected to only the third ends of the first to m-th data lines DL1-DLm, the fourth ends of the first to m-th data lines DL1-DLm do not extend to the fourth peripheral area PA4. Although the light sensing part 400 is disposed at the first end portion SP1 of the display area DA, the light sensing part 400 does not overlap with the first to m-th data lines DL1-DLm.

The second ends of the first to n-th gate lines DL1-DLn do not extend to the second peripheral area PA2 because the gate driving chip 210 is electrically connected to only the first ends of the first to n-th gate lines DL1-DLn. Although the light sensing part 400 is disposed at the second end portion SP2 of the display area DA, the light sensing part 400 does not overlap with the first to n-th gate lines DL1-DLn.

Therefore, although the light sensing part 400 is disposed in the display area DA, the liquid crystal display apparatus 710 may prevent distortion of the gate signal or the data signal provided to the display area DA.

The liquid crystal display apparatus 710 according to another exemplary embodiment of the present invention includes the light sensing part 400 disposed at the first and second end portions SP1 and SP2, so that the liquid crystal display apparatus 710 may more precisely sense the light amount of the external light L2 than the liquid crystal display apparatus 700 that includes the light sensing part 400 disposed at the end portion SP of the display area DA.

Figure 5:
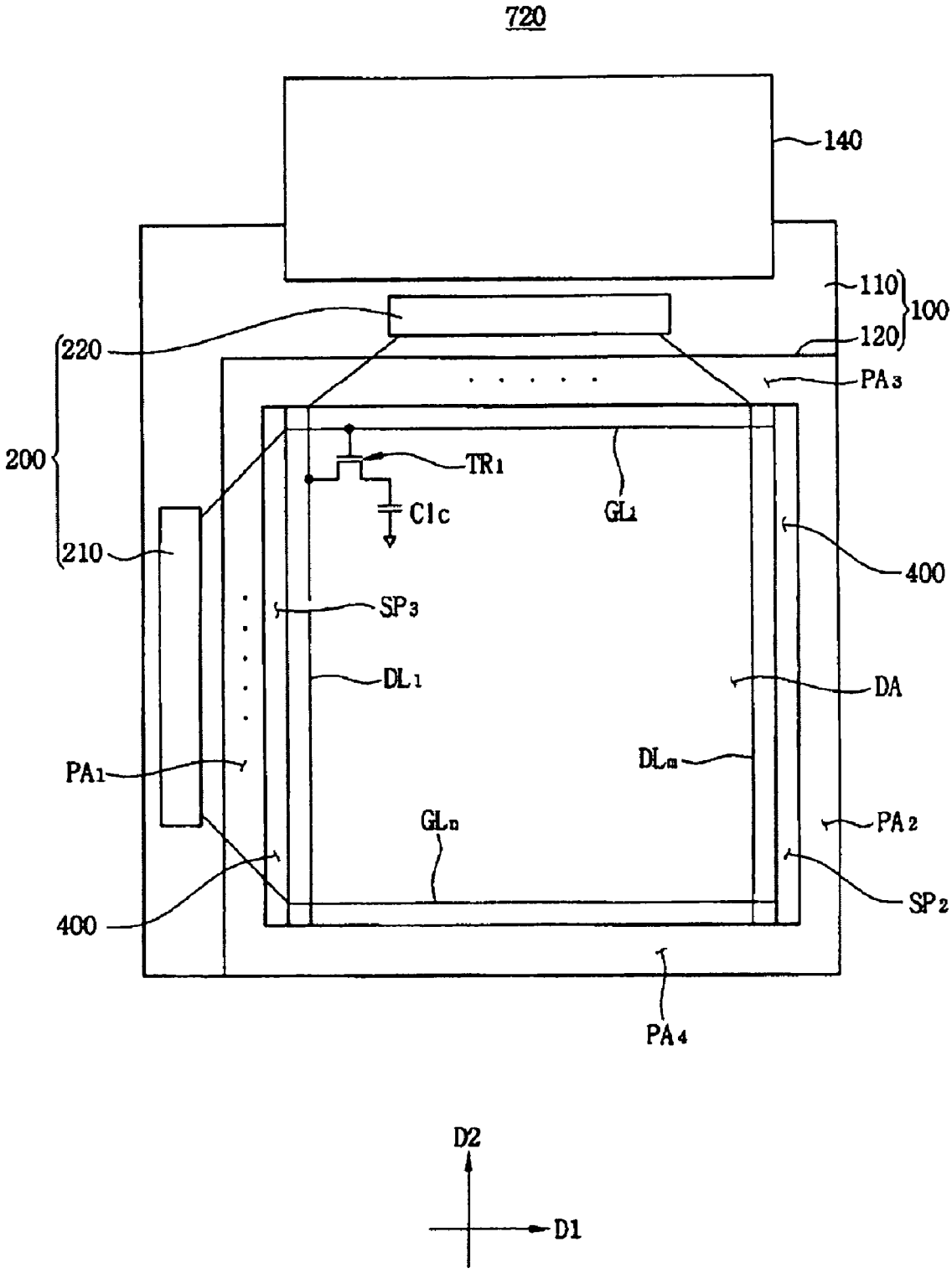
FIG. 5 is a plane view showing a liquid crystal display apparatus according to another exemplary embodiment of the present invention.

FIG. 5 is a plane view showing a liquid crystal display apparatus according to another exemplary embodiment of the present invention.

Referring to FIG. 5, a light sensing part 400 according to another exemplary embodiment of the present invention is disposed at a second end portion SP2 adjacent to the second peripheral area PA2 and at a third end portion SP3 adjacent to the first peripheral area PA3.

In the display area DA, the first to m-th data lines DL1-DLm have a length longer than that of the first to n-th gate lines GL1-GLn. Thus, the liquid crystal display panel 100 has a length of the second direction D2 longer than a length of the first direction D1. The first to n-th gate lines GL1-GLn are extended in the first direction D1 and the first to m-th data lines DL1-DLm are extended in the second direction D2.

Accordingly, a size of the light sensing part 400 formed at the second and third end portions SP2 and SP3 of the display area DA may be reduced. As a result, a liquid crystal display apparatus 720 according to another exemplary embodiment may include many of light sensing part in comparison with the liquid crystal display apparatuses 700 and 710, thereby more precisely sensing the light amount of the external light L2.

Since the gate driving chip 210 is electrically connected to only the first ends of the first to n-th gate lines GL1-GLn, the second ends of the first to n-th gate lines GL1-GLn do not extend to the second peripheral area PA2. Thus, although the light sensing part 400 is disposed at the second end portion SP2 of the display area DA, the light sensing part 400 does not overlap with the first to n-th gate lines GL1-GLn. Therefore, although the light sensing part 400 is disposed in the display area DA, the liquid crystal display apparatus 720 may prevent distortion of the gate signal or the data signal provided to the display area DA.

In FIGS. 2 to 5, the liquid crystal display apparatus into which the gate driving circuit packaged in a chip form is mounted in the first peripheral area PA1 of the liquid crystal display panel 100. Although not shown in FIGS. 2 to 5, the gate driving circuit may be formed at the lower substrate 110 by a thin film transistor process.

Figure 6:
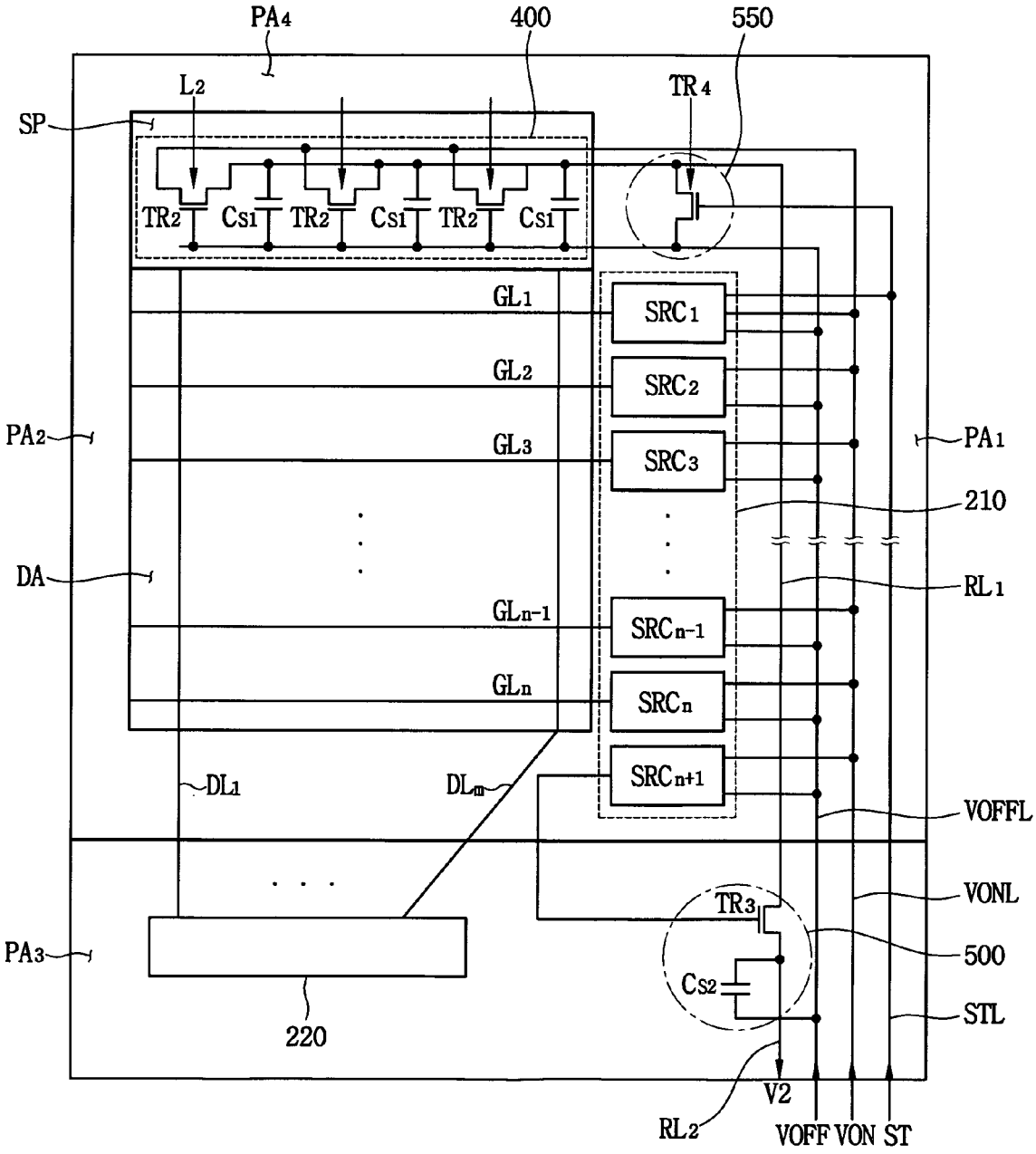
FIG. 6 is a circuit diagram showing the liquid crystal display apparatus shown in FIG. 1.
Figure 7:
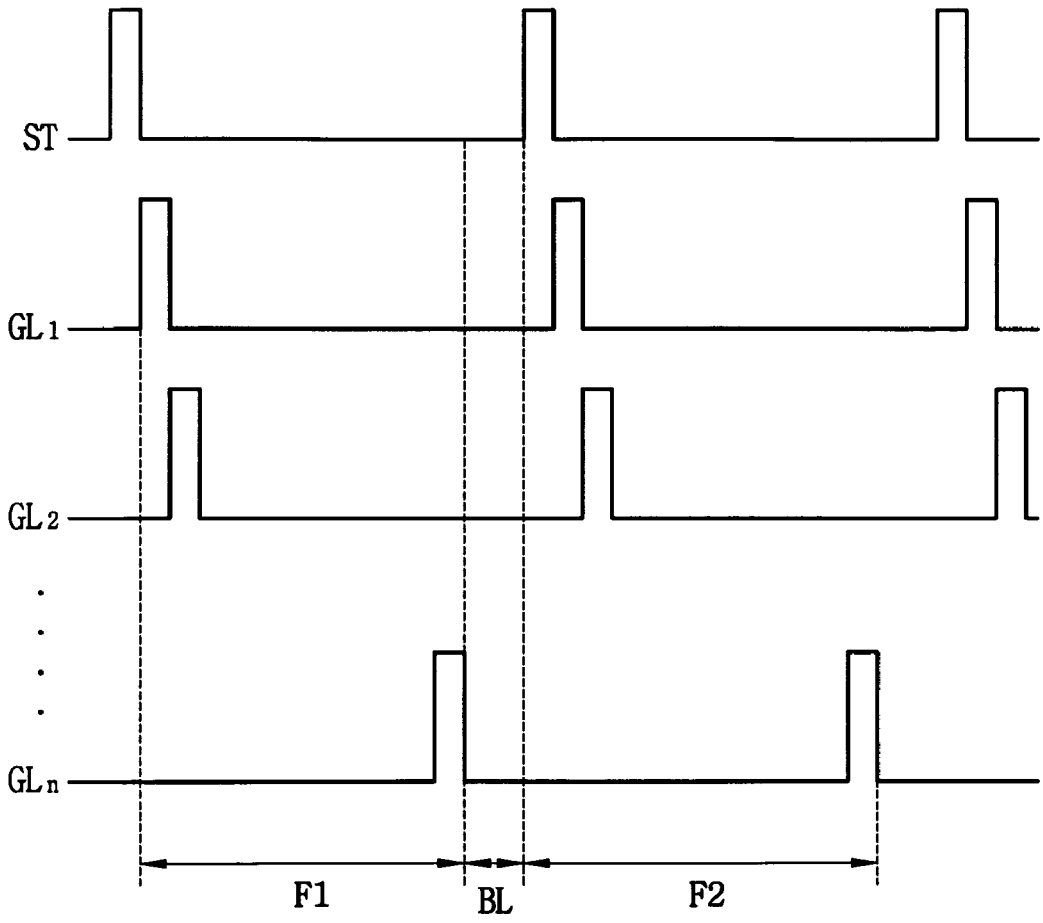
FIG. 7 is input/output waveforms of a gate driving chip.

FIG. 6 is a circuit diagram showing the liquid crystal display apparatus shown in FIG. 1. FIG. 7 is input/output waveforms of a gate driving chip.

Referring to FIG. 6, the light sensing part 400 is disposed at the end portion SP of the display area DA. Also, the gate and data driving chips 210 and 220 are mounted in the first and third peripheral areas PA1 and PA2 adjacent to the display area DA, respectively.

The light sensing part 400 will be described in detail with reference to FIGS. 8 and 9 in below.

The gate driving chip 210 includes a shift register having a plurality of stages SRC1-SRCn+1 connected one after another to each other. The first to n-th gate lines GL1-GLn are electrically connected to the stages SRC1-SRCn, respectively, so as to receive the gate signal outputted from a corresponding stage.

A first driving voltage wire VONL and a second driving voltage wire VOFFL are formed in the first peripheral area PA1 adjacent to the gate driving chip 210. The first and second driving voltage wires VONL and VOFFL are extended in the first direction D1 (refer to FIG. 2). A start signal wire STL adjacent to the first driving voltage wire VONL is further formed in the first peripheral area PA1 so as to provide the start signal ST to the first stage SRC1.

As shown in FIG. 7, when the start signal ST is provided to the first stage SRC1 during a first frame F1, the first stage SRC1 provides the gate signal to the first gate line GL1.

The second stage SRC2 outputs the gate signal to the second gate line GL2 in response to the gate signal outputted from the first stage SRC1. During the first frame F1, the gate signal is sequentially provided to the first gate line GL1 to the n-th gate line GLn.

When the start signal ST is reapplied to the first stage SRC1, a second frame F2 is started. In the second frame F2, a same process as that in the first frame F1 is repeated.

A blank interval BL exists between the first and second frames F1 and F2. The gate signal provided to the first to n-th gate lines GL1-GLm during the first frame F1 is discharged during the blank interval BL, and thus the first to n-th gate lines GL1-GLm are initialized during the blank interval BL.

The last stage SRCn+1 among the stages SRC1-SRCn+1 acts as a first dummy stage so as to drive the n-th stage SRCn.

Figure 8:
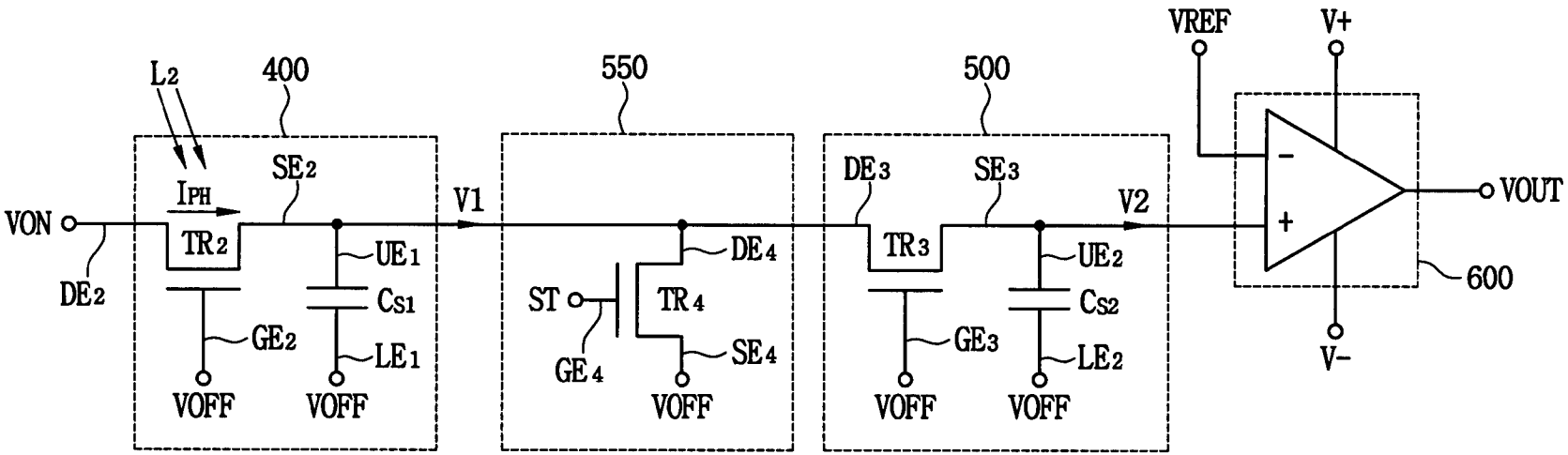
FIG. 8 is a circuit diagram showing the light sensing part shown in FIG. 6.

FIG. 8 is a circuit diagram showing the light sensing part shown in FIG. 6. FIG. 9 is input/output waveforms at respective nodes shown in FIG. 1.

Referring to FIGS. 6 to 8, the light sensing part 400 includes a plurality of sensing TFTs TR2, a plurality of first storage capacitor Cs1, and a first readout wire RL1.

Each of the sensing TFTs TR2 includes a gate electrode GE2 electrically connected to the second driving voltage wire VOFFL, a drain electrode DE2 electrically connected to the first driving voltage wire VONL, and a source electrode SE2 electrically connected to the first readout wire RL1. The sensing TFT TR2 outputs the photocurrent $I_{PH}$ to the source electrode SE2 in response to the external light L2.

Each of the first storage capacitor Cs1 includes a first electrode LE1 electrically connected to the second driving voltage wire VOFFL and a second electrode UE1 electrically connected to the first readout wire RL1 and insulated from the first electrode LE1. The first storage capacitor Cs1 charges a first voltage V1 corresponding to the photocurrent $I_{PH}$ outputted from the sensing TFT TR2.

The first readout wire RL1 is commonly connected to the first storage capacitors Cs1, and the first voltage V1 charged into the first storage capacitors Cs1 is discharged through the first readout wire RL1. The first readout wire RL1 is extended from the display area DA to the first peripheral area PA1. Then, the first readout wire RL1 is bent in the first peripheral area PA1 toward a direction substantially parallel to the data line DL1, and extended to the third peripheral area PA3.

The third peripheral area PA3 further includes a readout part 500 formed therein. The readout part 500 includes a readout TFT TR3, a second storage capacitor Cs2, and a second readout wire RL2. The readout TFT TR3 includes a gate electrode GE3 electrically connected to an output terminal of the last stage SRCn+1 of the shift register, a drain electrode DE3 electrically connected to the first readout wire RL1, and a source electrode SE3 electrically connected to the second readout wire RL2. The second storage capacitor Cs2 includes a first electrode LE2 electrically connected to the second driving voltage wire VOFFL and a second electrode UE2 electrically connected to the second readout wire RL2.

When the readout TFT TR3 is turned on in response to the output signal outputted from the last stage SRCn+1, the first voltage V1 provided to the first readout wire RL1 is charged into the second storage capacitor Cs2 through the readout TFT TR3.

The second driving part 600 includes an operational amplifier (OP-AMP) electrically connected to the readout part 500. The OP-AMP 600 compares a voltage outputted from the second readout wire RL2 with the predetermined reference voltage VREF. The OP-AMP 600 receives a first control voltage V+ and a second control voltage V−, and outputs one of the first control voltage V+ and the second control voltage V− in accordance with the compared result. Thus, the first control voltage V+ or the second control voltage V− is outputted from the OP-AMP 600.

The first peripheral area PA1 further includes a resetting part 550 that initializes the light sensing part 400 every predetermined time interval. The resetting part 550 includes a resetting TFT TR4 having a gate electrode GE4 electrically connected to the start signal wire STL, a drain electrode DE4 electrically connected to the first readout wire RL1, and a source electrode SE4 electrically connected to the second driving voltage wire VOFFL.

Responsive to the start signal, the resetting TFT TR4 discharges an electric charge charged into the first storage capacitor Cs1 as the second driving voltage VOFF through the second driving voltage wire VOFFL. Thus, the resetting TFT TR4 may initialize the first storage capacitor Cs1 periodically.

Figure 9:
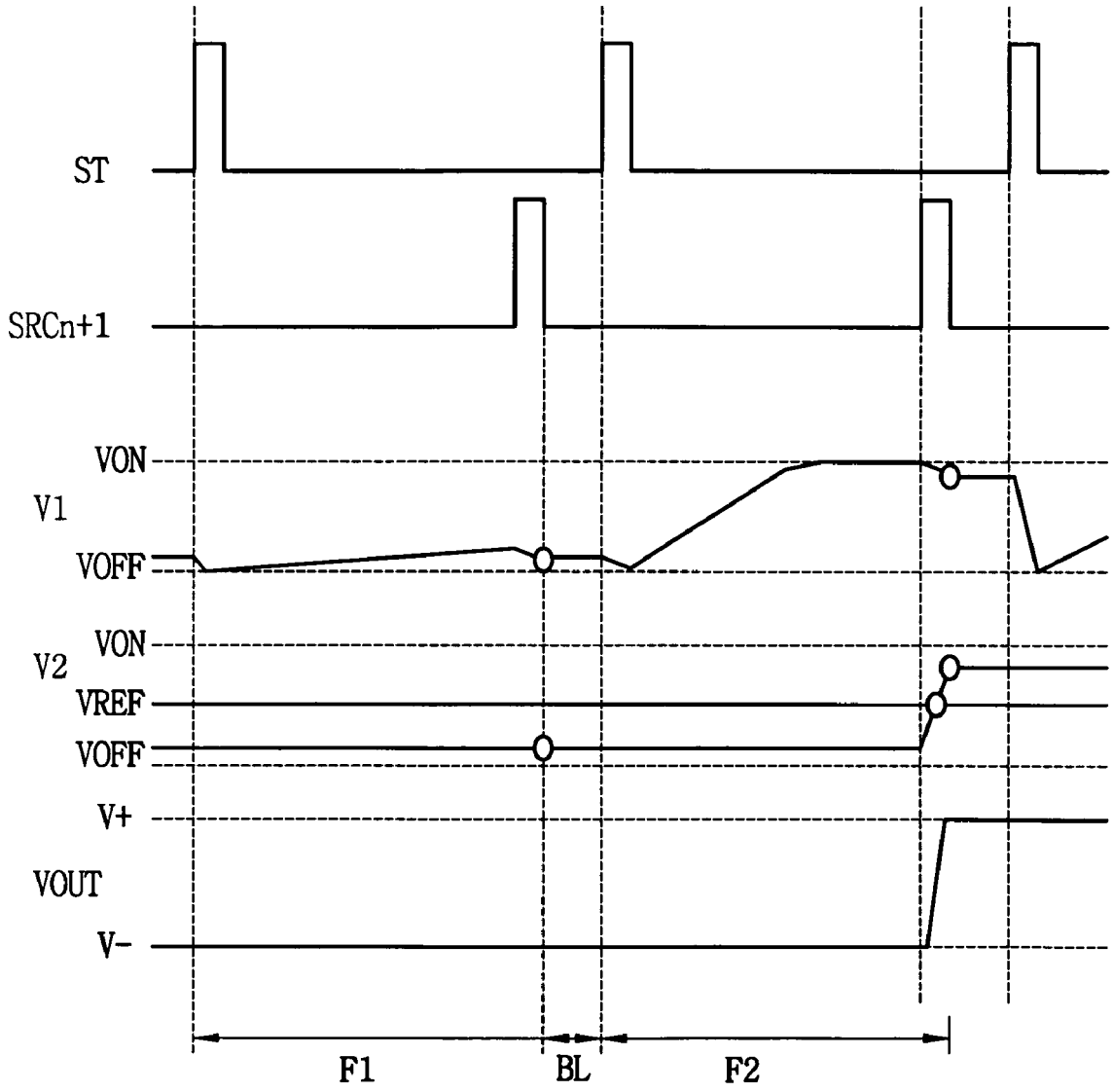
FIG. 9 is input/output waveforms at respective nodes shown in FIG. 1.

As shown in FIG. 9, when the light amount of the external light L2 decreases, the photocurrent $I_{PH}$ outputted from the sensing TFT TR2 also decreases. As a result, since the first voltage V1 charged into the first storage capacitor Cs1 has a low voltage level, the first voltage V1 slightly increases in comparison with the second driving voltage VOFF during the first frame F1.

The readout TFT TR3 is turned on in response to the output signal outputted from the last stage SRCn+1. Thus, the first voltage V1 provided to the first readout wire RL1 is charged into the capacitor Cs2 through the readout TFT TR3.

The OP-AMP 600 receives the second voltage V2 charged into the second storage capacitor Cs2 through the second readout wire RL2, and compares the received second voltage V2 with the predetermined reference voltage VREF. The OP-AMP 600 outputs an output voltage VOUT having a voltage level equal to that of the second control voltage V− because the second voltage V2 is smaller than the reference voltage VREF.

When the resetting TFT TR4 is turned on in response to the start signal ST indicating start of the second frame F2, the first voltage V1 charged into the first storage capacitor Cs1 is discharged at the second driving voltage VOFF. That is, the resetting TFT TR4 initializes the light sensing part 400 whenever each frame is started.

When the light amount of the external light L2 increases, the photocurrent $I_{PH}$ outputted from the sensing TFT TR2 also increases. As a result, since the first voltage V1 charged into the first storage capacitor Cs1 has a high voltage level, the first voltage V1 increases from the second driving voltage VOFF to the first driving voltage VON during the second frame 2.

The readout TFT TR3 is turned on in response to the output signal outputted from the last stage SRCn+1. Thus, the first voltage V1 provided to the first readout wire RL1 is charged into the second storage capacitor Cs2 through the readout TFT TR3.

The OP-AMP 600 receives the second voltage V2 charged into the second storage capacitor Cs2 through the second readout wire RL2, and compares the received second voltage V2 with the reference voltage. The OP-AMP 600 outputs an output voltage VOUT having a voltage level equal to that of the first control voltage V+ because the second voltage V2 is smaller than the reference voltage VREF.

Referring to FIGS. 1, 8 and 9, the output voltage VOUT outputted from the OP-AMP 600 may have the voltage level of the first control voltage V+ or the voltage level of the second control voltage V− in accordance with the light amount of the external light L2. In case that the first control voltage V+ is outputted from the OP-AMP 600 as the output voltage VOUT, the light generating part 300 does not emit the internal light L1 in response to the output voltage VOUT. However, in case that the second control voltage V− is outputted from the OP-AMP as the output voltage VOUT, the light generating part 300 emits the internal light L1 in response to the output voltage VOUT.

Accordingly, the liquid crystal display apparatus 700 may appropriately turn on or turn off the light generating part 300 in response to the light amount of the external light L2, thereby reducing an electrical power consumed to drive the liquid crystal display apparatus 700.

In FIGS. 6 to 8, a circuit diagram that the gate electrode GE3 of the readout TFT TE3 is electrically connected to the last stage SRCn+1 has been described.

However, the gate electrode GE3 of the readout TFT TR3 may be electrically connected to one of the stages SRC1-SRCn+1 forming the gate driving chip 210. In consideration of a line resistance, it is proper that the gate electrode GE3 of the readout TFT TR3 is electrically connected to the last stage SRCn+1 or the n-th stage SRCn.

Although not shown in FIGS. 1 to 9, the gate driving chip 210 may further include a second dummy stage positioned at a former position of the first stage SRC1 so as to drive the resetting part 550. In case that the gate driving chip 210 includes the second dummy stage, the resetting part 550 receives an output of the second dummy stage in lieu of the start signal ST, and the resetting part 550 is driven before the first stage SRC1 is driven by the start signal ST. Thus, the resetting part 550 may initialize the light sensing part 400 before the gate driving chip 210 is driven.

As one exemplary embodiment of the present invention, the second driving part 200 includes an OP-AMP so as to allow the light generating part 300 to be turned on or turned off. However, the second driving part 200 may be configured in another circuit diagram that is able to control intensity of the internal light L1 emitted from the light generating part 300 in accordance with the light amount of the external light L2.

Figure 10:
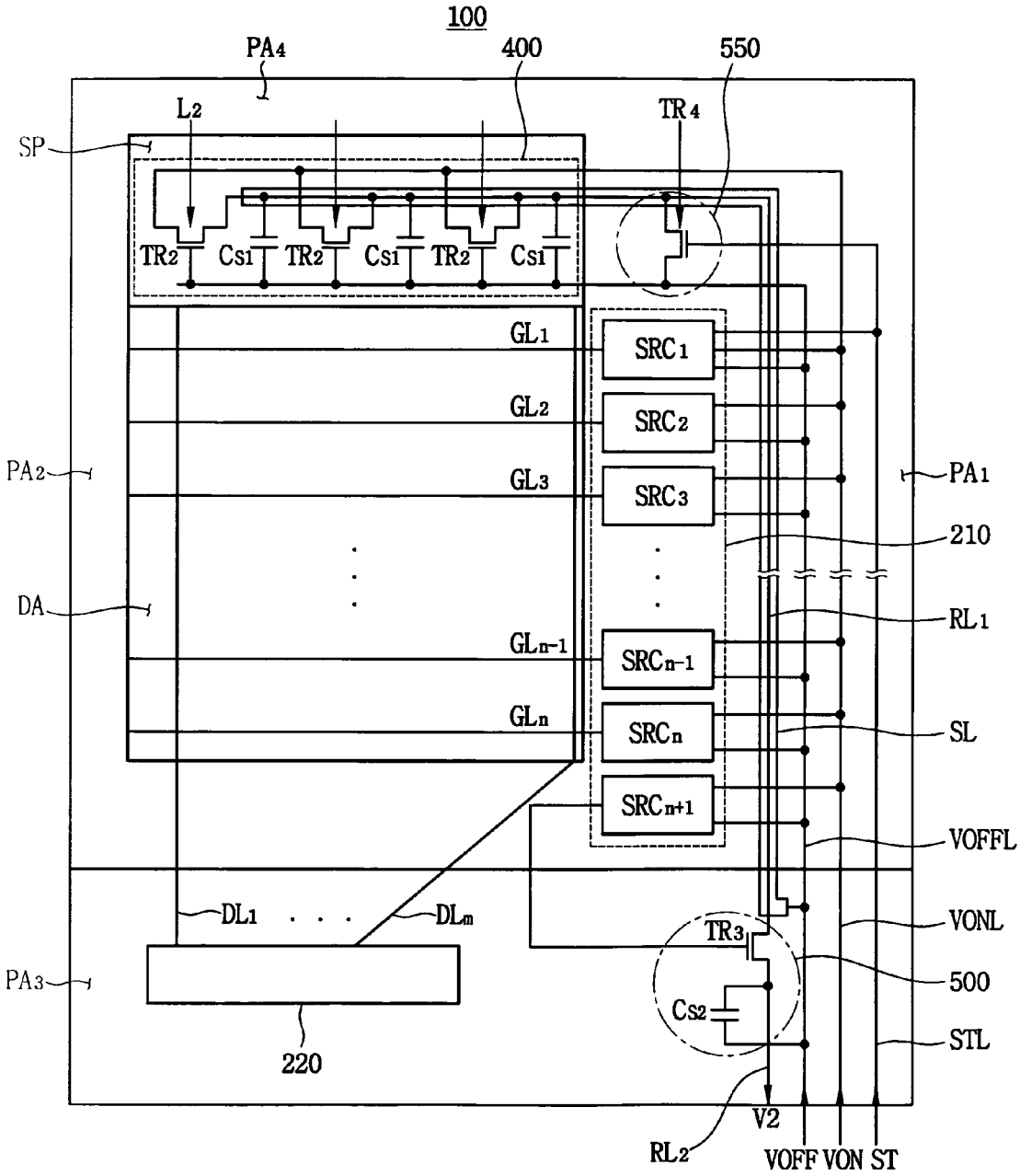
FIG. 10 is a circuit diagram showing a liquid crystal display panel according to another exemplary embodiment of the present invention.
Figure 11:
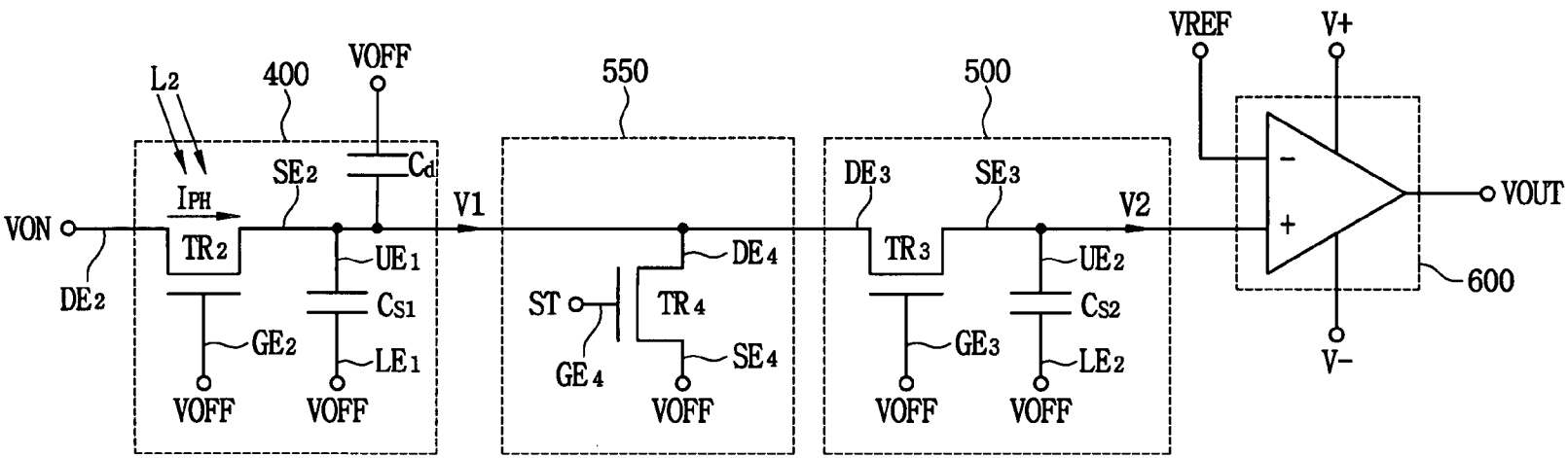
FIG. 11 is a circuit diagram showing the light sensing part shown in FIG. 10.

FIG. 10 is a circuit diagram showing a liquid crystal display panel according to another exemplary embodiment of the present invention. FIG. 11 is a circuit diagram showing the light sensing part shown in FIG. 10. In FIGS. 10 and 11, the same reference numerals denote the same elements in FIGS. 1 to 9, and thus the detailed descriptions of the same elements will be omitted.

Referring to FIGS. 10 and 11, a light sensing part 400 according to another exemplary embodiment of the present invention includes a plurality of sensing TFTs TR2, a plurality of first storage capacitor Cs1, a first readout wire RL1 and a shield wire SL.

The shield wire SL is electrically connected to the second driving voltage wire VOFFL in the first peripheral area PA1 so as to receive the second driving voltage VOFF. The shield wire SL is disposed on the first readout wire RL1 to protect the first readout wire RL1. Thus, the shield wire SL blocks various noises disturbing signals transferred through the first readout wire RL1 so as to prevent distortion of the signals transferred through the first readout wire RL1.

The shield wire SL faces the first readout wire RL1, and is insulated from the first readout wire RL1. Thus, a dummy capacitor Cd is formed between the shield wire SL and the first readout wire RL1, and the dummy capacitor Cd is connected to the first storage capacitor Cs1 in parallel. The shield wire SL may receive a ground voltage instead of the second driving voltage VOFF.

The shield wire SL will be described in detail with reference to FIG. 12 in below.

Figure 12:
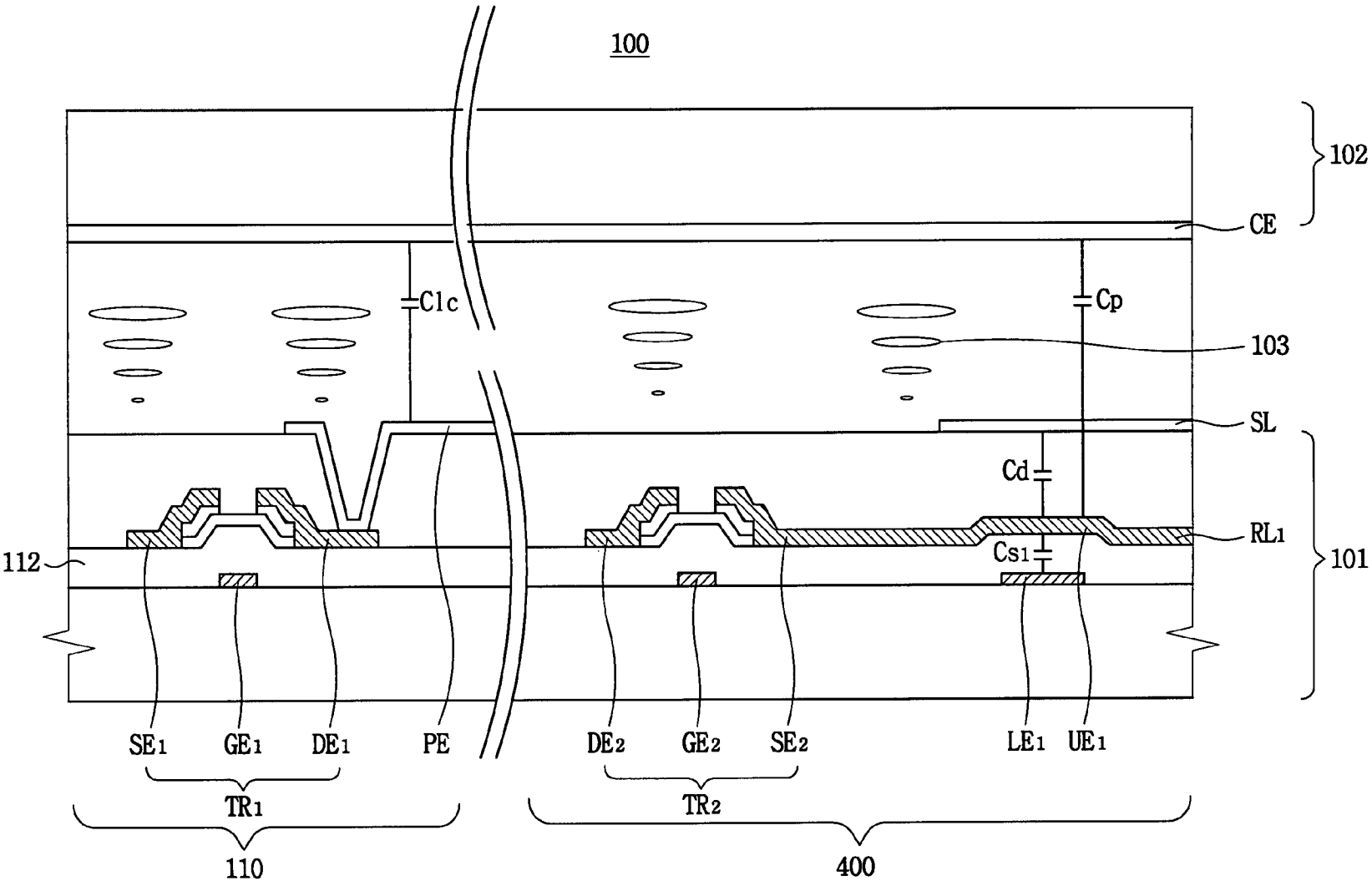
FIG. 12 is a cross-sectional view of the liquid crystal display apparatus shown in FIG. 10.

FIG. 12 is a cross-sectional view of the liquid crystal display apparatus shown in FIG. 10.

Referring to FIG. 12, the liquid crystal display panel 100 includes the lower substrate 101, the upper substrate 102 facing the lower substrate 101, and the liquid crystal layer 103 interposed between the lower and upper substrates 101 and 102.

Responsive to the display area DA, the gate electrode GE1 of the pixel TFT TR1, the gate electrode GE2 of the sensing TFT TR2, and the first electrode LE1 of the first storage capacitor Cs1 are formed on the lower substrate 101. The gate electrodes GE1 and GE2 and the first electrode LE2 include a first metal layer. A gate insulating layer 112 including silicon nitride SiNx or silicon oxide SiOx is formed on the lower substrate 101 on which the gate electrodes GE1 and GE2 and the first electrode LE1 are completely formed.

The source electrode SE1 of the pixel TFT TR1, the drain electrode DE1 spaced apart from the source electrode SE1, the source electrode SE2 of the sensing TFT TR2, the drain electrode DE2 spaced apart from the source electrode SE2, and the second electrode UE1 of the first storage capacitor Cs1 are formed on the gate insulating layer 112. The source electrodes SE1 and SE2, the drain electrodes DE1 and DE2 and the second electrode UE2 include a second metal layer.

The first readout wire RL1 is electrically connected to the source electrode SE2 of the sensing TFT TR2 and to the second electrode UE1 of the first storage capacitor Cs1. The first readout wire RL1 may include the first metal layer or the second metal layer. In FIG. 12, the first readout wire RL1 including the second metal layer has been described.

When the pixel TFT TR1, the sensing TFT TR2 and the first storage capacitor Cs1 are completely formed on the lower substrate 101, an organic insulating layer 114 is formed on the lower substrate 101 on which the pixel TFT TR1, the sensing TFT TR2 and the first storage capacitor Cs1 are completely formed. The organic insulating layer 114 has a contact hole 114*a* formed therethrough so as to expose the drain electrode DE1 of the pixel TFT TR1. The pixel electrode PE including indium tin oxide (ITO) or indium zinc oxide (IZO) is formed on the organic insulating layer 114. The pixel electrode PE is electrically connected to the drain electrode DE1 through the contact hole 114*a*.

Also, the shield wire SL including the ITO or the IZO is formed on the organic insulating layer 114. The shield wire SL formed on the organic insulating layer 114 faces the first readout wire RL1. Thus, the dummy capacitor Cd is formed between the shield wire SL and the first readout wire RL1.

The common electrode CE including the ITO or the IZO is formed on the upper substrate 102. The common electrode CE forms the liquid crystal capacitor Clc with the pixel electrode PE facing the common electrode CE.

A parasitic capacitance Cp occurs between the common electrode CE and the first readout wire RL1. The parasitic capacitance Cp may distort the first voltage V1 transferred through the first readout wire RL1. Thus, the parasitic capacitance Cp must be reduced so as to prevent distortion of the first voltage V1.

$$Vn1 = \frac{Cp}{Cp + Cs1} \cdot V1 \qquad \text{Equation 1}$$

In Equation 1, Vn1 indicates a first noise voltage Vn1 distorting the first voltage V1 before forming the shield wire SL. In accordance with Equation 1, the first noise voltage Vn1 depends upon the parasitic capacitance Cp and a capacitance combined with the first readout wire RL1. Before forming the shield wire SL, the first readout wire RL1 is connected only to the first storage capacitor Cs1.

When the shield wire SL is formed, a second noise voltage Vn2 satisfies Equation 2 as follows.

$$Vn2 = \frac{Cp}{Cp + Cs1 + Cd} \cdot V1 \qquad \text{Equation 2}$$

The first readout wire RL1 is connected to the first storage capacitor Cs1 and the dummy capacitor Cd by means of the shield wire SL. Thus, the second noise voltage Vn2 becomes lower than the first noise voltage Vn1. When the dummy capacitance Cd increases, the second noise voltage Vn2 is reduced in proportion to increase of the dummy capacitance Cd, thereby preventing distortion of the first voltage V1.

According to the display apparatus, the display panel that displays the image includes the light sensing part that senses the external light. The second driving part controls the light generating part that generates the internal light in accordance with the light amount of the external light sensed by the light sensing part.

Thus, the display apparatus may turn on or turn off the light generating part based on the light amount of the external light, thereby reducing the electrical power consumed to drive the display apparatus.

The first readout wire that outputs the first voltage corresponding to the light amount of the second light is shielded by the shield wire so as to prevent distortion of the first voltage transferred through the first readout wire. Accordingly, the display apparatus may prevent malfunction of the light generating part caused by distortion of the first voltage.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising:

a light generating part to generate a first light in response to a driving signal;

a first driving part to output a panel driving signal;

a display panel to receive the first light from the light generating part or a second light externally provided, and to display an image in response to the panel driving signal;

a light sensing part disposed in the display panel so as to output a sensing signal in response to a light amount of the second light;

a second driving part to compare the sensing signal with a predetermined reference value, and to provide the driving signal to the light generating part in accordance with the compared result, wherein the display panel comprises a display area having a plurality of gate lines and a plurality of data lines to display the image and a peripheral area adjacent to the display area, and the light sensing part is disposed in the display area;

the light sensing part has a sensing transistor to output the sensing signal in response to the second light, and a first storage capacitor to charge a first voltage corresponding to the sensing signal, and a first readout wire electrically connected to the first storage capacitor so as to readout the first voltage;

the first driving part has a gate driving circuit having a plurality of stages connected one after another to each other so as to output a gate signal to the gate lines in response to a first driving voltage, a second driving voltage and a start signal; and the sensing transistor has a drain electrode receiving the first driving voltage, a gate electrode receiving the second driving voltage, and a source electrode outputting the sensing signal.

2. The display apparatus of claim 1, wherein the peripheral area comprises:

a first peripheral area adjacent to first ends of the gate lines;

a second peripheral area adjacent to second ends of the gate lines, the second ends being opposite to the first ends;

a third peripheral area adjacent to third ends of the data lines; and a fourth peripheral area adjacent to fourth ends of the data lines, the fourth ends being opposite to the third ends.

3. The display apparatus of claim 2, wherein the first driving part comprises:

the gate driving circuit disposed in the first peripheral area and electrically connected to the first ends of the gate lines so as to output the gate signal to the gate lines; and a data driving circuit disposed in the third peripheral area and electrically connected to the third ends of the data lines so as to output a data signal to the data lines.

4. The display apparatus of claim 3, wherein the light sensing part is disposed in the display area, and is adjacent to the fourth peripheral area.

5. The display apparatus of claim 3, wherein the light sensing part is disposed in the display area, and is adjacent to the first and second peripheral areas.

6. The display apparatus of claim 3, wherein the light sensing part is disposed in the display area, and is adjacent to the second and fourth peripheral areas.

7. The display apparatus of claim 1, wherein the first storage capacitor comprises:

a first electrode to which the second driving voltage is applied; and a second electrode to which the sensing signal is applied.

8. The display apparatus of claim 1, wherein the light sensing part is disposed on the first readout wire, and insulated from the first readout wire, and wherein the light sensing part further comprises a shield wire so as to prevent distortion of the first voltage read out through the first readout wire.

9. The display apparatus of claim 8, wherein the shield wire receives the second driving voltage.

10. The display apparatus of claim 8, wherein the display area comprises:

a pixel transistor connected to a corresponding gate line of the gate lines and a corresponding data line of the data lines; and a electrode part electrically connected to the pixel transistor.

11. The display apparatus of claim 10, wherein the electrode part comprises a pixel electrode and a common electrode facing the pixel electrode, wherein a liquid crystal layer is interposed between the pixel electrode and the common electrode, and wherein the shield wire is disposed on a layer on which the pixel electrode is disposed, and disposed between the first readout wire and the common electrode.

12. The display apparatus of claim 1, further comprising a readout part to readout the first voltage charged into the first storage capacitor.

13. The display apparatus of claim 12, wherein readout part comprises:

a readout transistor to output a second voltage in response to a readout signal and the first voltage;

a second storage capacitor to charge the second voltage outputted from the readout transistor; and a second readout wire connected to the second storage capacitor so as to readout the second voltage.

14. The display apparatus of claim 13, wherein the readout transistor comprises a first drain electrode receiving the first voltage, a first gate electrode receiving the readout signal, and a first source electrode outputting the second voltage.

15. The display apparatus of claim 14, wherein the readout signal is an output signal of a last stage among the plurality of stages.

16. The display apparatus of claim 13, wherein the second storage capacitor comprises:

a first electrode to which the second driving voltage is applied; and a second electrode to which the second voltage is applied.

17. The display apparatus of claim 1, further comprising a resetting part to periodically reset the light sensing part in accordance with a predetermined time.

18. The display apparatus of claim 17, wherein the resetting part comprises a first gate electrode receiving a reset signal, a first drain electrode receiving the first voltage, and a first source electrode receiving the second driving voltage.

19. The display apparatus of claim 18, wherein the reset signal is the start signal.

20. The display apparatus of claim 1, wherein the second driving part comprises an OP-AMP to compare the sensing signal with the reference value, and outputs the driving signal in accordance with the compared result.

21. The display apparatus of claim 20, wherein the driving signal comprises a first driving signal so as to turn on the light generating part and a second driving signal so as to turn off the light generating part, and wherein the OP-AMP outputs the first driving signal when the sensing signal is smaller than the reference value, and outputs the second driving signal when the sensing signal is greater than the reference value.

22. A display apparatus comprising:

a light generating part to generate a first light in response to a driving signal;

a first driving part to output a panel driving signal;

a display panel having a display area having a plurality of gate lines and a plurality of data lines so as to display the image and a peripheral area adjacent to the display area, the display panel receiving the first light from the light generating part or a second light externally provided, and displaying an image in response to the panel driving signal;

a light sensing part to output a sensing signal in response to a light amount of the second light; and a second driving part to compare the sensing signal with a predetermined reference value, and to provide the driving signal to the light generating part in accordance with the compared result, the peripheral area comprises a first peripheral area adjacent to first ends of the gate lines, a second peripheral area adjacent to second ends of the gate lines, the second ends being opposite to the first ends, a third peripheral area adjacent to third ends of the data lines, and a fourth peripheral area adjacent to fourth ends of the data lines, the fourth ends being opposite to the third ends;

the light sensing part is disposed in the display area, and is adjacent to at least one peripheral area of the first, second, third and fourth peripheral areas;

the light sensing part has a sensing transistor to output the sensing signal in response to the second light, and a first storage capacitor to charge a first voltage corresponding to the sensing signal, and a first readout wire electrically connected to the first storage capacitor so as to readout the first voltage;

the first driving part has a gate driving circuit having a plurality of stages connected one after another to each other so as to output a gate signal to the gate lines in response to a first driving voltage, a second driving voltage and a start signal; and the sensing transistor has a drain electrode receiving the first driving voltage, a gate electrode receiving the second driving voltage, and a source electrode outputting the sensing signal.

23. The display apparatus of claim 22, wherein the first storage capacitor comprises a first electrode receiving the second driving voltage and a second electrode receiving the sensing signal.

24. The display apparatus of claim 22, wherein the light sensing part is disposed on the first readout wire, and insulated from the first readout wire, and wherein the light sensing part further comprises a shield wire so as to prevent distortion of the first voltage read out through the first readout wire.

25. The display apparatus of claim 24, wherein the shield wire receives the second driving voltage.

26. A display apparatus comprising:

a light generating part to generate a first light in response to a driving signal;

a first driving part to output a panel driving signal;

a display panel to receive the first light from the light generating part or a second light externally provided, and to display an image in response to the panel driving signal;

a light sensing part disposed in the display panel so as to output a sensing signal in response to a light amount of the second light;

a second driving part to compare the sensing signal with a predetermined reference value, and to provide the driving signal to the light generating part in accordance with the compared result, wherein the display panel comprises a display area having a plurality of gate lines and a plurality of data lines to display the image and a peripheral area adjacent to the display area, and the light sensing part is disposed in the display area and extends substantially an entire width of the display area;

the light sensing part has a sensing transistor to output the sensing signal in response to the second light, and a first storage capacitor to charge a first voltage corresponding to the sensing signal, and a first readout wire electrically connected to the first storage capacitor so as to readout the first voltage;

the first driving part has a gate driving circuit having a plurality of stages connected one after another to each other so as to output a gate signal to the gate lines in response to a first driving voltage, a second driving voltage and a start signal; and the sensing transistor has a drain electrode receiving the first driving voltage, a gate electrode receiving the second driving voltage, and a source electrode outputting the sensing signal.

* * * * *